US012440734B1

(12) United States Patent
Reyna

(10) Patent No.: US 12,440,734 B1
(45) Date of Patent: Oct. 14, 2025

(54) PRO-TRACT GOLF WEDGE

(71) Applicant: Raymond Mark Reyna, Fairfield, CA (US)

(72) Inventor: Raymond Mark Reyna, Fairfield, CA (US)

( * ) Notice: Subject to any disclaimer, the term of this patent is extended or adjusted under 35 U.S.C. 154(b) by 0 days.

(21) Appl. No.: 17/883,627

(22) Filed: Aug. 9, 2022

(51) Int. Cl.
*A63B 53/04* (2015.01)

(52) U.S. Cl.
CPC ..... *A63B 53/0441* (2020.08); *A63B 53/047* (2013.01); *A63B 2053/0479* (2013.01)

(58) Field of Classification Search
CPC ..... A63B 53/0441; A63B 53/047; A63B 2053/0479
USPC ..... 473/219–256, 282–292, 324–350
See application file for complete search history.

(56) References Cited

U.S. PATENT DOCUMENTS 1,485,272 A * 2/1924 Kinsman ..... A63B 53/047 473/242
4,174,839 A * 11/1979 Marrs ..... A63B 69/3685 473/252
4,222,567 A * 9/1980 Shabala ..... A63B 53/04 473/242
5,776,016 A * 7/1998 Benoit ..... A63B 69/3632 473/409
6,244,974 B1 * 6/2001 Hanberry, Jr. ..... A63B 53/007 473/340
6,605,006 B2 * 8/2003 Mason ..... A63B 60/52 473/331
D484,936 S * 1/2004 Fleck ..... D21/749
7,594,862 B2 * 9/2009 Gilbert ..... A63B 53/04 473/331
7,909,708 B2 * 3/2011 Gilbert ..... A63B 53/04 473/331
2005/0075185 A1 * 4/2005 Green ..... A63B 69/3685 473/409
2013/0012331 A1 * 1/2013 Goldsmith ..... A63B 53/0466 473/409

* cited by examiner

*Primary Examiner* — Nini F Legesse
(74) *Attorney, Agent, or Firm* — Plager Schack LLP; Mark H. Plager; Naomi Mann

(57) ABSTRACT

Disclosed is a golf club system which helps a golfer visually determine an alignment or swing direction of a golfclub with respect to a golf ball by providing alignment lines inscribed within the club face.

10 Claims, 3 Drawing Sheets

PRO-TRACT GOLF WEDGE

BACKGROUND

The present disclosure relates generally to golf club systems and to golf wedges.

It is difficult for most golf players to visually determine an alignment and/or degree of openness of a golf ball with respect to the club. As such, an improved golf system which addresses this limitation is desirable.

SUMMARY

According to various embodiments, disclosed is a golf club system which helps a golfer visually determine an alignment or swing direction of a golfclub with respect to a golf ball by providing alignment lines inscribed within the club face.

In embodiments, the golf club may comprise a shaft; and a clubhead coupled to the shaft, the clubhead including a club face wherein the club face includes a base edge and a top edge and wherein the club face is at a loft angle with respect to the shaft, wherein the club face includes a vertical line which is in perpendicular alignment to the base edge and centered about the base edge, said vertical line configured to indicate a square alignment of the club face with respect to a ball being hit by the golf club. In further embodiments, the golf club may comprise at least one alternate angle mark, the alternate angle mark comprising a line which is angled with respect to the vatical line, and is configured to indicate an angle of open alignment of the club face with respect to a ball being hit by the golf club. In some embodiments, the vertical line and alternate angle mark extend from a common central point at or proximate to the base edge to the top edge.

In further embodiments, the golf club includes multiple alternate angle marks which fan out from the common central point. In certain embodiments, the golf club includes at least one alternate mid angle mark between the vertical line and alternate angle mark and/or between successive alternate angle marks. In some embodiments, the golf club includes multiple alternate angle marks, wherein successive marks increase by a constant angle of between 2 and 5 degrees. In further embodiments, successive alternate angle marks successively increase by 4 degrees from the vertical line. In certain embodiments, the golf club includes mid angle marks between the vertical line and alternate angle mark and between successive alternate angle marks. In some embodiments, the golf club is a wedge, and the vertical line indicates the loft of the wedge. In certain embodiments, the vertical line and alternate angle mark are etched or lasered onto the club face.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
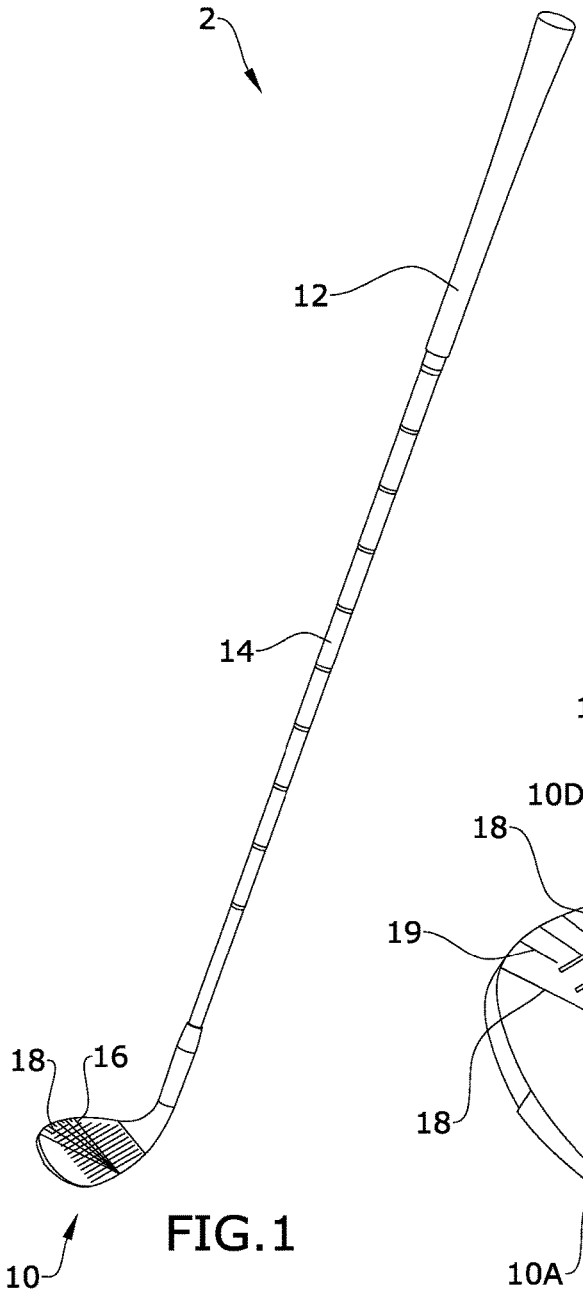
FIG. 1 is a perspective view of a golf wedge, in accordance with various embodiments.
Figure 2:
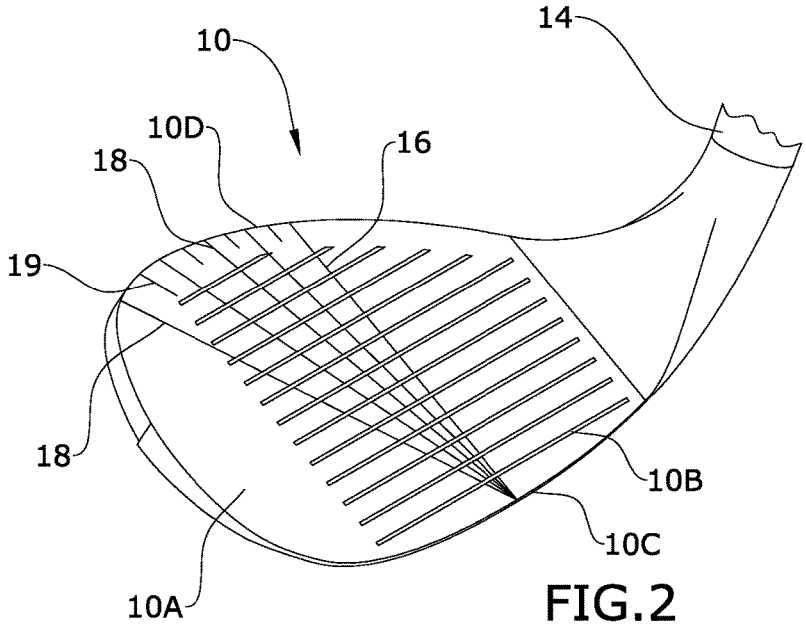
FIG. 2 is a detailed perspective view thereof.
Figure 3:
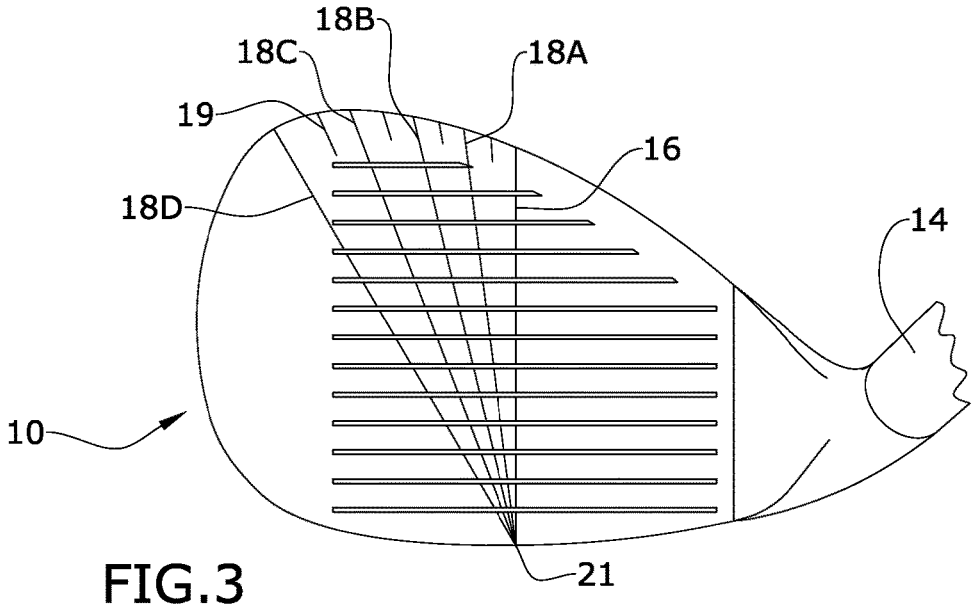
FIG. 3 is a top view of the wedge face of the golf wedge.
Figure 4:
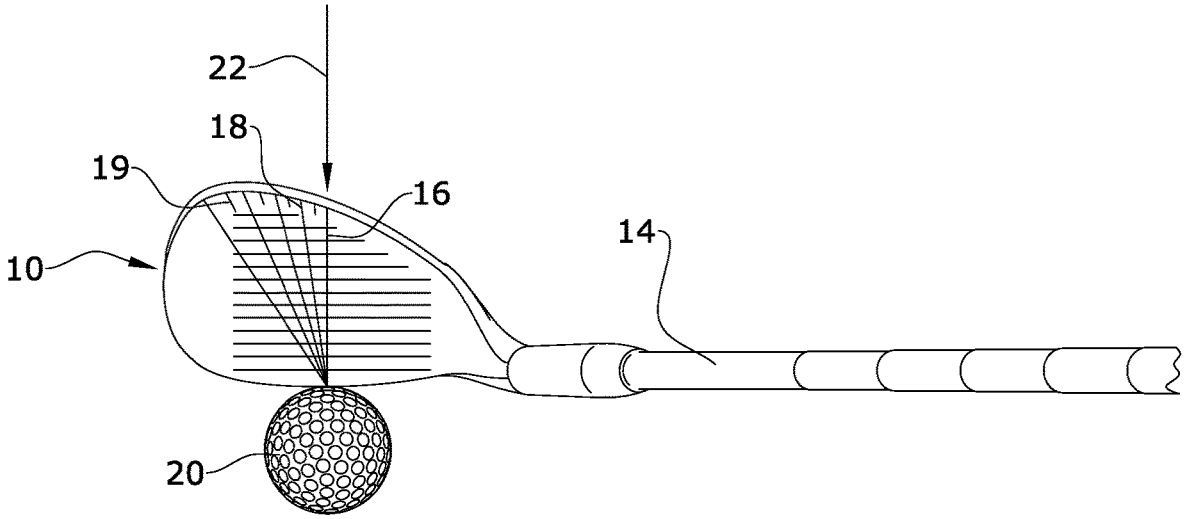
FIG. 4 is a top view of the golf wedge shown in use.

According to various embodiments as depicted in FIGS. 1-5, disclosed is a golf club system which helps a golfer visually determine an alignment or swing direction 22 of a golfclub 2 with respect to a golf ball 20 by providing alignment lines inscribed within the club face.

In embodiments, golfclub 2 may generally include a shaft 14 coupled to a clubhead 10, and may further include a grip 12 for holding the golfclub. In further embodiments, club face may include horizontal grooves 10B which may help backspin, flight control and/or maintenance of contact with the ball.

In certain embodiments, golfclub 2 may be a wedge, which is a type of iron club, with a high angle (i.e., loft) between the club face 10A and the vertical plane or shaft. Such clubs may typically be used for short-distance, high-altitude shots such as hitting the ball onto the green or getting the ball out of the rough. Examples of wedges include, but are not limited to gap, sand, and lob wedges. In certain embodiments, the wedge loft may be higher than approximately 52°, but is not limited to this option. It shall be appreciated that the disclosed subject matter may apply to other types of golfclubs including different types of clubheads in alternate embodiments.

In certain embodiments, club face 10A includes a vertical line 16 which extends vertically along a center of the club face 10A to match the angle or loft of the wedge. This visually indicates the "sweet spot" of the wedge face 10A with respect to golf ball 20, such that the golfer may align club face 10A "square" to the ball, i.e., at 90° with respect to the target line at impact (see FIG. 4).

Figure 5:
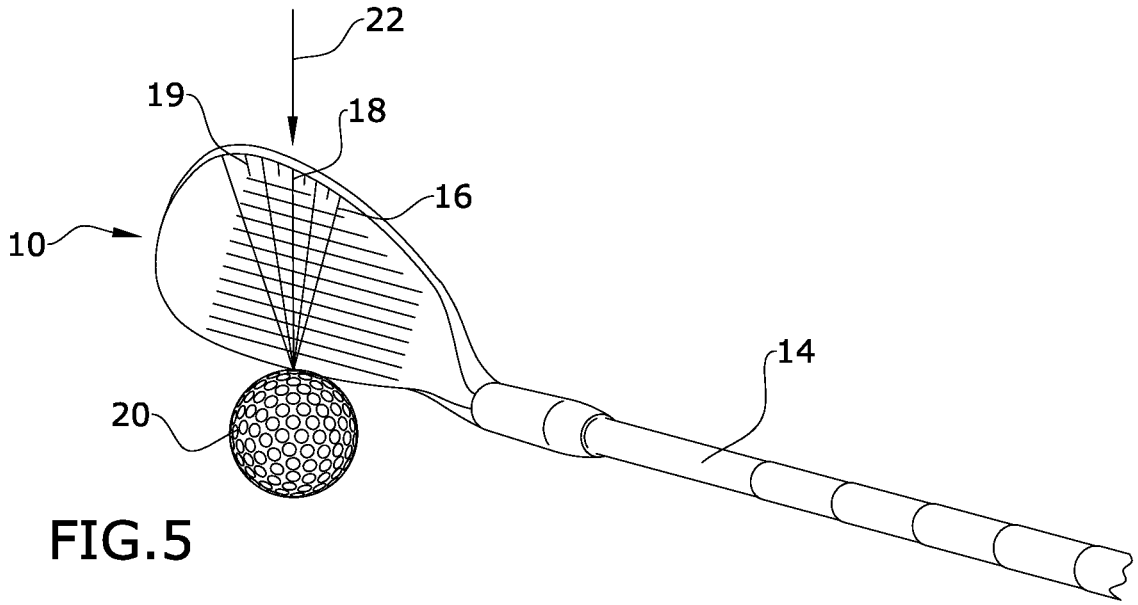
FIG. 5 is a further top view of the golf wedge shown in use.

In further embodiments, club face 10A may also include alternate angle marks 18 and alternate mid angle marks 19 on club face 10A, which help the golfer align club face 10A "open" to the ball, i.e., at an angle greater than 90° with respect to the target line, wherein the toe of the club is tilted back such that the toe is behind the heel at impact (see FIG. 5). Such open alignment may be desirable when performing short chip shots to the green and may enable the golfer to hit the ball higher and/or land the ball more softly on the green.

In certain embodiments, vertical line 16, and alternate angle marks/mid angle marks 18, 19 may be etched or lasered within wedge face 10A. It shall be appreciated that various other methods of imprinting vertical line 16, and alternate angle marks/mid angle marks 18, 19 may be used in alternate embodiments.

In certain embodiments, vertical line 16, and alternate angle marks 18 may start from a single point 21 on or proximate base edge 10C (i.e., the leading edge) of club face 10A, and extend or fan out to or proximate the top edge 10D of face 10A as shown. In some embodiments, alternate midline marks 19 may extend downwards from the crown, between alternate marks 18, as shown.

In embodiments, point 21 may be approximately centered between the toe and heel of clubhead 10. Vertical line 16 may extend vertically upwards from base 10C, and may be in perpendicular alignment to base 10C and/or to a line tangent to base 10C at point 21.

In further embodiments, alternate angle marks 18 may successively increase by a constant of between about 1 to 5 degrees. In one embodiment, alternate marks may successively increase by about 4 degrees from vertical line 16, wherein alternate mid angle marks 19 mark the midpoint between adjacent marks 18 and increase by 2 degrees from marks 18. In certain embodiments, club face 10A may include about 4 alternate angle marks 18 and 4 mid alternate angle marks 19, however it shall be appreciated that any number of marks 18, 19 may be used in alternate embodiments. In some further embodiments, the numerical values of the angles may also be imprinted next to vertical line 16, alternate angle marks 18, and/or mid angle marks 19.

For example, a wedge listed at 56 degrees may start with a numeric value of 56 degrees listed next to vertical line 16, a numeric value of 60 degrees listed next to a first alternate angle mark 18A, a numeric value of 64 degrees listed next to a second alternate angle mark 18B, a numerical value of 68 degrees listed next to a third alternate angle mark 18C, and a numeric value of 72 degrees listed next to a fourth alternate angle mark 18D. As the lines are fanned out, the numeric value placed next to each line/mark enables the golfer to readily see when the club face is open, and the degree of openness when club face 10A is lined up with golf ball 20.

This eliminates guess work in using a golf wedge and/or when turning the handle facing the target for opening the club. Additionally, the disclosed subject matter provides a wedge with several degree options.

It shall be appreciated that the disclosed golf club system can have multiple configurations in different embodiments. It shall be appreciated that the components of the golf club system described in several embodiments herein may comprise any alternative known materials in the field and be of any size and/or dimensions. It shall be appreciated that the components of golf club system described herein may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A golf club comprising:

a shaft;

a clubhead coupled to the shaft, the clubhead including a club face wherein the club face includes a base edge and a top edge and wherein the club face is at a loft angle with respect to the shaft, wherein the club face includes a vertical line which is in perpendicular alignment to the base edge and approximately centered about the base edge, said vertical line configured to indicate a square alignment of the club face with respect to a ball being hit by the golf club, wherein the golf club is a wedge, and wherein the vertical line indicates the loft of the wedge, wherein the club face further includes multiple alternate angle marks for directing an angle of open alignment of the club face with respect to a ball being hit by the golf club, the alternate angle marks comprising at least 3 angled lines which intersect at a common point of convergence with the vertical line, the common point of convergence being at or proximate the base edge, wherein the angled lines extend only towards the toe of the club head from the common point of convergence in a direction away from the shaft, and at angles which increase in uniform succession from the vertical line by a constant positive value of between about 1 to 5 degrees.

2. The golf club of claim 1, further comprising at least one alternate mid angle mark between said vertical line and an angled line adjacent said vertical line and/or between successive angled lines that are adjacent one another.

3. The golf club of claim 2, further comprising one alternate mid angle marks between said vertical line and said angled line adjacent said vertical line, and one alternate mid angle mark between successive angled lines adjacent one another.

4. The golf club of claim 3, wherein the alternate mid angle marks indicate a midpoint between adjacent lines of the vertical line and the angled lines.

5. The golf club of claim 4, wherein the golf club has one vertical line, and 4 angled lines that fan out from the common point of convergence.

6. The gold club of claim 2, wherein the mid angle mark extends from the top edge towards the base edge of the club face.

7. The golf club of claim 6, wherein there is a separation between adjacent lines of about 4 degrees, and a separation between the mid angle marks are separated by about 2 degrees from each line to which it is adjacent.

8. The golf club of claim 1, wherein the constant positive value of successive angle increase of the angled lines is at least approximately 2 degrees.

9. The golf club of claim 8, wherein the constant positive value of successive angle increase of the angled lines is approximately 4 degrees.

10. The golf club of claim 1, wherein said vertical line and alternate angle mark are etched or lasered onto the club face.

* * * * *